United States Patent [19]

Lerch

[11] 4,333,407

[45] Jun. 8, 1982

[54] LIFTING DEVICE FOR THE PRESSER FOOT OF A SEWING MACHINE

[75] Inventor: Werner Lerch, Steckborn, Switzerland

[73] Assignee: Fritz Gegauf Aktiengesellschaft Bernina-Nahmaschinenfabrik, Steckborn, Switzerland

[21] Appl. No.: 92,061

[22] Filed: Nov. 6, 1979

[30] Foreign Application Priority Data

Nov. 9, 1978 [CH] Switzerland ..... 11520/78

[51] Int. Cl.[3] ..... D05B 29/00

[52] U.S. Cl. ..... 112/237

[58] Field of Search ..... 112/237, 239, 238, 311

[56] References Cited

U.S. PATENT DOCUMENTS

| | | | |
|---|---|---|---|
| 319,766 | 6/1885 | White | 112/239 X |
| 386,868 | 7/1888 | Dimond et al. | 112/237 |
| 1,009,408 | 11/1911 | Hagelstein | 112/237 |
| 1,042,429 | 10/1912 | Green | 112/239 |
| 2,986,105 | 5/1961 | Maxant | 112/237 X |
| 3,661,102 | 5/1972 | Tice | 112/239 X |

FOREIGN PATENT DOCUMENTS

| | | |
|---|---|---|
| 53542 | 1/1967 | German Democratic Rep. . |
| 532150 | 5/1972 | Switzerland . |
| 836214 | 6/1960 | United Kingdom . |
| 839233 | 6/1960 | United Kingdom . |
| 1052592 | 12/1966 | United Kingdom . |
| 1164502 | 9/1969 | United Kingdom . |
| 1267291 | 3/1972 | United Kingdom . |

*Primary Examiner*—Werner H. Schroeder
*Assistant Examiner*—Andrew M. Falik
*Attorney, Agent, or Firm*—Birch, Stewart, Kolasch & Birch

[57] ABSTRACT

A lifting device for the presser foot of a sewing machine comprising an operating lever provided on a front face of the sewing machine for synchronous knee or arm operation. The operating lever is connected via a linkage to one end of a double lever arranged in the proximity of the rear side of the machine. The other end of the double lever engages the presser bar. The double lever is supported to be pivotable in a vertical plane. An upwardly projecting guide arm is operatively connected to the lever arm and includes a detent member which is in engaging relationship in a groove which is disposed in a vertical plane. The groove extends approximately in the shape of a heart and closes on itself. The groove has, at the tip of the heart, a lower detent location and, in the central zone between the two upper arcs of the heart an upper detent location for receiving the detent member. Upper stop locations are positioned in the upper arcs of the heart. The lifting device is especially suitable for sewing machines operated by handicapped persons.

8 Claims, 2 Drawing Figures

LIFTING DEVICE FOR THE PRESSER FOOT OF A SEWING MACHINE

BACKGROUND AND SUMMARY OF THE INVENTION

The present invention relates to a lifting device for the presser foot of a sewing machine.

Conventional lifting devices such as, for example, the one disclosed in Swiss Pat. No. 532,150, are in most cases relatively cumbersome in operation, i.e., they contain one or even two operating elements which are operated in different ways by hand and are located in the zone of the stitching site or on the rear side of the head of the machine. Apart from the fact that these devices in most cases involve a complicated construction, they can only be operated with great difficulty, especially by the handicapped. Devices of this type, which can be operated by the knee or the foot, have been proposed, for example, in East German Pat. No. 53,542, wherein an operating lever is provided which is operable always toward the same side by the foot or knee for the lifting as well as the lowering of the presser foot. However, the motion transmission to the presser foot and/or the arresting of the latter in its upper end position require relatively complicated lever and spring systems which not only occupy a relatively large amount of space but also demand a relatively large amount of energy, and are susceptible to disturbances.

The present invention avoids these disadvantages. The device of the present invention comprises an operating lever operable in the same direction for lifting and lowering the presser foot. The presser foot, which is under a spring force in its lowering direction, is characterized in that a double lever is operatively connected at one end to the operating lever and engaged at its other end with a presser bar counteracting the spring force, and the double lever is operatively connected to a guide arm between this point of engagement and its pivot bearing. The guide arm contains a detent member guided in an inherently closed and defined path. Starting from a lower detent location, the curved path has a first path section ascending to a first upper stop and thereafter descending to a catch detent, followed by a second path section likewise ascending to a second upper stop and then returning to the lower detent location. When the detent member is positioned in the lower catch detent, the presser foot assumes its lower final position wherein a first operation of the operating lever lifts the detent member along the first path section up to the first upper stop. When the operating lever is released, the detent member automatically falls into the catch detent determining the lifted position of the presser foot. Upon a renewed operation of the operating lever, the detent member is lifted from the detent into the second path section up to the second upper stop thereof. Upon the renewed release of the operating lever, the detent member automatically returns to the lower detent location.

The confined guidance of the detent member in the inherently closed path, which is traversed always in the same direction, makes separately acted upon engagement and disengagement means superfluous. The primary portion of the device, consisting of a double lever, a guide arm with detent member, and closed path, is simple in construction and thus is not susceptible to disturbances and is practically service-free. The double lever, arranged, for example, horizontally, and disposed along the rear side of the long base of the machine, makes it possible in a simple way to locate the point of engagement of the linkage connecting the double lever to the operating lever which is disposed on the front face. The operating lever is operable, for example, by an individual's knee or arm, in the zone of the machine base which is especially advantageous for this purpose, i.e., remote from the actual working zone of the sewing machine.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
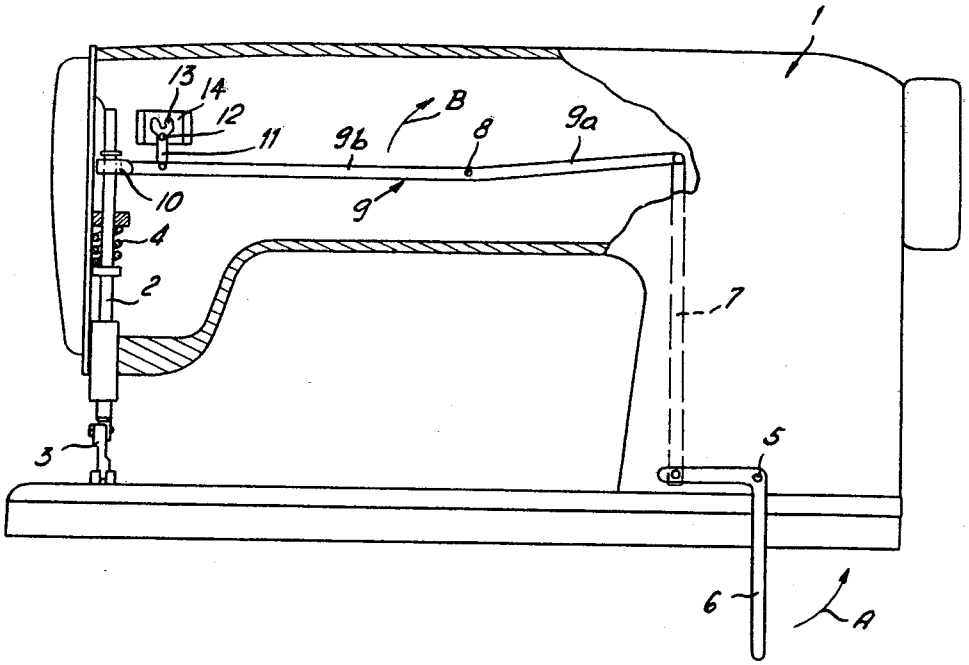
FIG. 1 is a front view of the sewing machine, partially in a vertical sectional view, with a schematically illustrated lifting device for the presser foot.

In FIG. 1, a machine base 1 and a presser bar 2 are operatively connected to the presser foot 3 which is mounted in the head of the base. A spring 4 acts upon the presser bar for lowering the same. On the front side of the base 1, an operating lever 6 is supported which, in FIG. 1, is schematically constructed as an angle lever pivotable about the fulcrum 5. The lever 6 is connected, by way of a linkage 7 to the shorter arm **9*a* of a double lever 9 extending along the column arm toward the column head and pivotably mounted at 8 in a vertical plane. The longer arm 9*b* of the double lever 9 terminates in a fork 10 extending underneath a collar of the presser bar 2. Directly in front of the fork 10, a guide arm 11 is supported at the arm 9*b* of the double lever 9. The free end of this guide arm carries a detent pin 12 movably guided in a vertical plane in a closed path 13 fixed in position above the double lever 9**, for example, at the base column.

Figure 2:
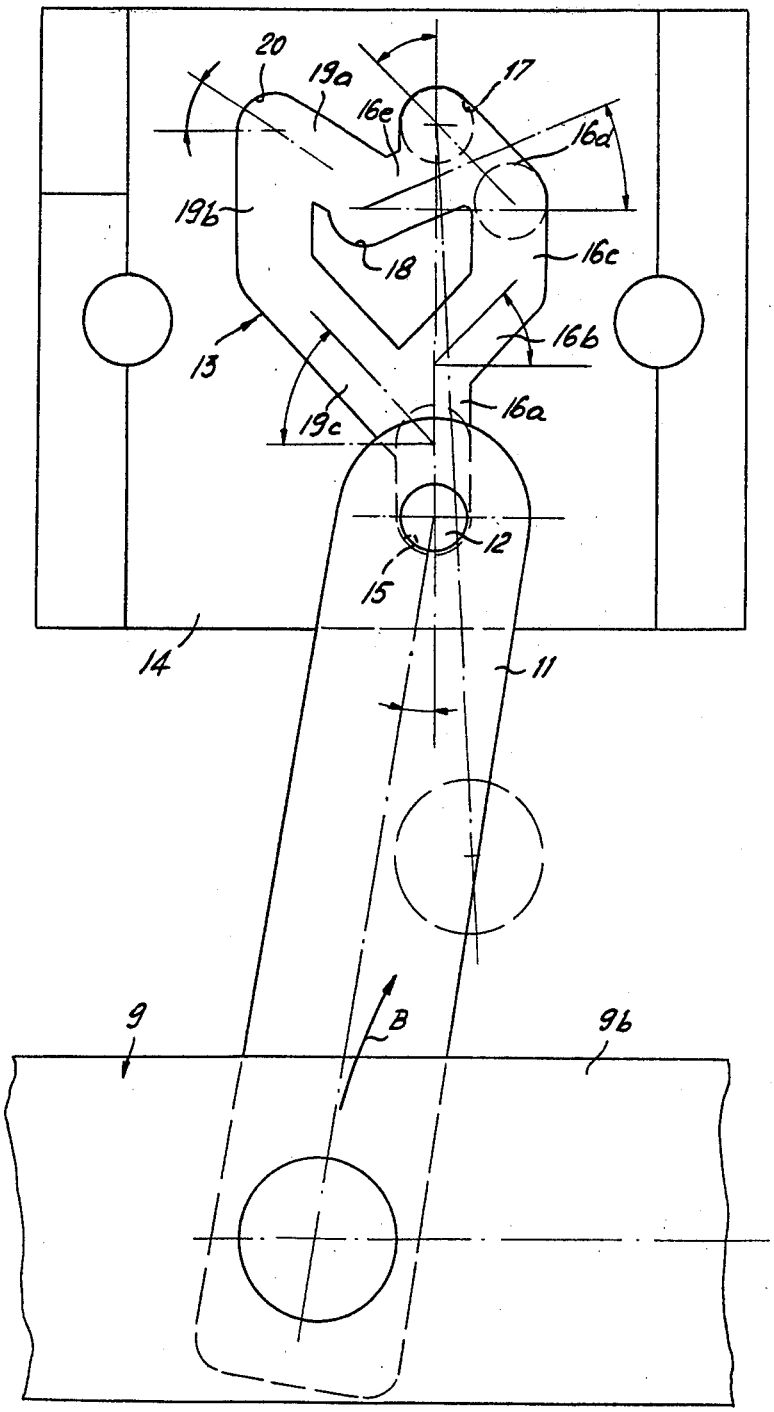
FIG. 2 shows, in an enlarged scale, the closed path with detent member, guide arm, and double lever pertaining to the device of FIG. 1.

The closed path 13, provided in a plate 14, is an inherently closed groove with a shape as shown in FIG. 2. Starting with a vertical groove section **16*a*, the lower portion 15 thereof serving as the detent location for the detent pin 12 and capable of encompassing the pin 12 over a full 180°, there follows, as seen in the counterclockwise direction, a groove section 16*b* inclined outwardly by about 45°, a vertical groove section 16*c*, and finally a groove section 16*d* inclined inwardly by 45°. This last-mentioned section terminates vertically above the detent location 15 in a first, upper stop location 17. Below the first stop location 17, a groove section 16*e* extends from the groove section 16*d* at an angle of about 22° inclined downwardly toward the horizontal and terminates approximately at the level of the groove section 16*c* in a catch detent 18. Above this catch detent 18, the groove section 16*e* is followed by a groove section 19*a* inclined upwardly by about 32° extending up to a second upper stop location 20, disposed at the same level as the stop location 17. The second stop location 20 is followed by a groove section 19*b* extending vertically downward, and from there a groove section 19*c* is inwardly inclined at an angle of about 45°. Groove section 19*c*** leads back to the vertical groove section 16*a*. The arrangement is such that when the presser foot 3 is lowered, the pin 12 is caught in the detent location 15 of groove 13 (FIG. 2). The operating lever 6 likewise assumes its rest position (FIG. 1).

If the operating lever 6 is now pivoted by pressure from an individual's knee or arm in the direction of arrow A (FIG. 1), then the double lever 9 is pivoted via the linkage 7 in the direction of arrow B. The ensuing result is a lifting of the presser foot 3 via the fork 10. As can be seen from FIG. 2, in the starting position of the double lever 9, the guide arm 11 carrying the detent pin 12 positioned in the detent location 15 is inclined slightly toward the right, by approximately 5°–10°. During the aforementioned pivoting of the double lever 9 in the direction of arrow B, this inclination has the effect that the pin 12, moving upwardly in the groove section 16*a* is moved positively toward the right into the groove section 16*b* due to the weighting effect of the inclined guide arm 11. Thus, a misdirection of the pin 12 into the groove section 19*c* is avoided. Consequently, the pin 12 follows the groove sections 16*b*, 16*c*, and 16*d* until it has reached the first stop location 17. This corresponds to the largest possible pivot angle of the operating lever 6 and of the double lever 9. The bearing point of the guide arm 11 has moved during this process into the position indicated in dashed lines in FIG. 2, i.e., it has been moved in a vertical direction a distance between the detent location 15 and the first stop location 17, and from one side (the left-hand side in FIG. 2) toward the other side (the right-hand side in FIG. 2). As a consequence, the guide arm 11 carrying the detent member 12 is inclined toward the left by at least a few degrees, so that during the release of the operating lever 6 and the double lever 9, the guide arm 11 moves the detent member 12 along the groove section 16*e* into the catch detent 18 wherein it is caught. This position of the detent member 12, elevated as compared to the starting position in detent location 15, corresponds to the raised position of the presser foot 3, wherein the presser foot is positively arrested. Upon a renewed actuation of the operating lever 6, which has returned to its starting position during the preceding release, in the direction of arrow A, the guide arm 11 and thus the detent member 12 are urged upwardly in the groove section 19*a* via the double lever 9 correspondingly pivoting in the direction of arrow B, until the second stop location 20 has been reached, and, during the subsequent release of the operating lever 6, the detent member is forced to descend through the groove sections 19*b* and 19*c* into the lower detent location 15. During this procedure, the double lever 9 has, of course, also moved back into its starting position, wherein the spring 4, exerting its force on the presser bar 2, moves the presser foot 3 back into its lowered position.

Consequently, the detent member 12 follows along an approximately heart-shaped, inherently closed path 13 in two steps, in a counterclockwise direction, subdivided by detent locations 15 and 18 which are disposed at different levels.

It can be seen from the above that the control elements 9, 11, 12, and 13 effect the lifting and locking in place, or the lowering of the presser foot due to the synchronous operation of the operating lever 6. Thus, the control elements consist of a few elements executing merely simple revolving motions, which provides a construction engineer maximum freedom in arranging the operating lever, which also executes a simple motion. This not only ensures a flawless functioning of the lifting device, but also makes the same particularly suitable for use in sewing machines to be operated by the handicapped, for example, by knee or arm pressure.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A device for raising and lowering a presser foot of a sewing machine which comprises:

an operating lever, operable in synchronization for lifting and lowering the presser foot;

a presser bar operatively connected to the presser foot and provided with spring bias means which acts to hold the presser foot in a normally lowered position;

a double lever arm operatively connected at one end to the operating lever and at the other end to the presser bar, whereby, movement of the operating lever imparts movement to the double lever arm thereby imparting movement to the presser bar to act against the spring bias means for raising the presser foot of the sewing machine and further movement of the operation lever imparts movement to the double lever arm thereby permitting the spring bias means to impart movement to the presser bar to lower the presser foot; and wherein a plate member containing a defined path is disposed adjacent to the double lever arm and a guide arm is operatively connected to the double lever arm, said guide arm being provided with a detent member which is adapted to traverse said defined path to selectively retain said double lever arm, said operating lever and said presser foot in a raised position and to normally enable said double lever arm, said operating lever and said presser foot to assume said lowered position.

2. The device according to claim 1, wherein the defined path is provided with a catch detent and a lower detent, said detent member traversing said defined path to be selectively positioned within said catch detent and said lower detent.

3. The device according to claim 1, wherein the detent member is a pin arranged at a free end of the guide arm and at right angles to the vertical pivot plane of the double lever, said pin engaging said defined path.

4. The device according to claim 3, wherein the defined path has a substantially heart shape.

5. The device according to claim 1, wherein said defined path is a closed compulsory path starting from a lower detent location and including a first path section ascending to a first upper stop and thereafter descending to a catch detent, followed by a second path section likewise ascending to a second upper stop and then returning to the lower detent location.

6. The device according to claim 5, wherein with the detent positioned in the lower detent location the presser foot assumes a lower final position and wherein a first operation of the operating lever lifts the detent member along the first path section up to said first upper stop, whereupon, when the operating lever is released, the detent member automatically falls into the catch detent which corresponds to the lifted position of the presser foot, upon a renewed operation of the operating lever, the detent member is lifted in the second path section from said catch detent up to said second upper stop and, upon the renewed release of the operating lever, returns automatically to the lower detent location wherein said presser foot again assumes its lower final position.

7. A lifting device for raising and lowering a presser foot of a sewing machine comprising:

an operable lever being operable in synchronization for lifting and lowering the presser foot, said presser foot being acted upon by spring pressure to be moved in a lowering direction, characterized in that a double lever is operatively connected at one end to the operating lever and engaged at the other end with a presser bar, counteracting the spring pressure;

said double lever arm being operatively connected to a guide arm between the point of engagement with said presser bar and a pivot bearing of said double lever arm, said guide arm including a detent member guided in an inherently closed compulsory path;

said closed compulsory path starting from a lower detent location and including a first path section ascending to a first upper stop and thereafter descending to a catch detent, followed by a second path section likewise ascending to a second upper stop and then returning to the lower detent location, in such a way that, with the detent member positioned in the lower detent location the presser foot assumes a lower final position and wherein a first operation of the operating lever lifts the detent member along the first path section up to said first upper stop, whereupon, when the operating lever is released, the detent member automatically falls into the catch detent which corresponds to the lifted position of the presser foot, upon a renewed operation of the operating lever, the detent member is lifted in the second path section from said catch detent up to said second upper stop thereof and, upon the renewed release of the operating lever, returns automatically to the lower detent location wherein said presser foot again assumes its lower final position.

8. A device for raising and lowering a presser foot of a sewing machine which comprises:

an operating lever, operable in synchronization for lifting and lowering the presser foot;

a presser bar operatively connected to the presser foot and provided with spring bias means which acts to hold the presser foot in a lowered position;

a double lever arm operatively connected at one end to the operating lever and at the other end to the presser bar, whereby, movement of the operating lever imparts movement to the double lever arm thereby imparting movement to the presser bar to act against the spring bias means for raising the presser foot of the sewing machine and further movement of the operation lever imparts movement to the double lever arm thereby permitting the spring bias means to impart movement to the presser bar to lower the presser foot; and a plate member containing a substantially heart shaped defined path operatively disposed adjacent to the double lever arm and a guide arm being operatively connected to the double lever arm, said guide arm being provided with a detent member which is adapted to traverse said defined path, said detent member being a pin arranged at a free end of the guide arm and at right angles to the vertical pivot plane of the double lever, said pin engaging said defined path.

* * * * *